United States Patent [19]

Traegaardh et al.

[11] Patent Number: 4,908,091

[45] Date of Patent: Mar. 13, 1990

[54] SPLICING DEVICE FOR PACKAGING WEBS

[75] Inventors: Paul Traegaardh, Tokyo; Hans Nantin, Trelleborg, Sweden

[73] Assignee: AB Tetra Pak, Lund, Sweden

[21] Appl. No.: 165,701

[22] Filed: Mar. 8, 1988

[30] Foreign Application Priority Data

Mar. 14, 1987 [JP] Japan ..... 62-59262

[51] Int. Cl.[4] ..... B65H 19/12; B65H 19/18; B65H 19/20

[52] U.S. Cl. ..... 156/502; 156/159; 156/504; 242/58.2

[58] Field of Search ..... 156/504, 505, 502, 159, 156/157; 242/56 R, 58.2, 58.3, 58.4, 58.5

[56] References Cited

U.S. PATENT DOCUMENTS

| | | | |
|---|---|---|---|
| 3,580,757 | 5/1971 | Neipmann | 156/504 |
| 4,081,312 | 3/1978 | Cristiani | 156/504 |
| 4,190,483 | 2/1980 | Ryan et al. | 156/504 |
| 4,392,912 | 7/1983 | Horsley | 156/504 |
| 4,629,531 | 12/1986 | Kataoka | 156/504 |

*Primary Examiner*—Michael Wityshyn
*Attorney, Agent, or Firm*—Birch, Stewart, Kolasch & Birch

[57] ABSTRACT

A splicing device for packaging webs comprises a dual magazine shiftable between an on-line position and a stand-by position. Both magazines can hold a web. When the web held in the on-line position is exhausted, the magazine is shifted and the web from the stand-by position can be used while the exhausted web is replaced. A joining unit is provided for each magazine to connect the end of an exhausted web with the end of a new web. A cutting unit is positioned at the on-line position for cutting a web in use whereby a new web may be joined thereto in an aligned manner. A feeding unit is provided upstream of the cutting unit and includes a crease wheel for feeding and folding the web. Another cutting unit is provided upstream of the feeding unit for severing the web in desired package lengths. The splicing device enables rapid joining of webs with a minimum of labor.

17 Claims, 15 Drawing Sheets

1
123
12
122
124
C
121
14
132
132
18
17
13
131
132
138
1'

SPLICING DEVICE FOR PACKAGING WEBS

BACKGROUND OF THE INVENTION

A container for packaging drinks such as milk, juice, and the like, is made from a large roll of laminated material (hereinafter referred to as a web), which is wound and continuously supplied and which is subsequently processed such as by cutting, folding, joining, and the like, at predetermined positions. If the container is fabricated into a cylindrical shape, it is closed at its bottom, filled with contents, and the top is closed while being held by a filling machine.

The present invention relates to the device for joining such a web to be processed with a new web roll.

DESCRIPTION OF THE BACKGROUND ART

The conventional system for joining the end of the web to be processed with an end of a new web is that, when the web being used is exhausted, it is manually cut at a predetermined position and the new web is loaded into the magazine on the production line. The end of the new web and the end of the exhausted web are manually joined with the help of auxiliary joining tape.

When the web on the production line becomes exhausted in such a system, there is need for installing the new roll of the web on the production line.

Nevertheless, this kind of web is so large and heavy that the work of filling the magazine with the new web requires time and physical labor. In particular, since the work of making a replacement with the new roll of the web consumes time, the production has to be suspended during that time, and the production efficiency is lowered. For this reason, replacement of the roll of the web as soon as possible is desired.

SUMMARY OF THE INVENTION

In order to solve such a conventional defect and to realize the aforementioned requirement at the same time, the present invention is concerned with the arrangement in which the new roll of the web awaits processing in a position adjacent the production line, (i.e., a stand-by position adjacent to the production position), and will thereafter be moved to the production position when the first web is exhausted or when a change in the type of web is desired. These webs can be automatically joined with each other.

As a specific means for attaining the aforementioned purpose, the present invention is provided with a magazine capable of moving the roll of the web into any production position in which the packaging web is to be fed, as well as into two stand-by positions located at the left and right sides, respectively, of said production position (on-line position). The splicing unit is capable of joining the end of the packaging web being used with the end of the new roll of the web which is moved from the stand-by position to the production position. The production position is located in the middle of the aforementioned two stand-by positions.

The roll of packaging web being used and installed in the magazine located on the production line, i.e., the production position, is continuously fed out at a fixed speed. In the magazine located on any of the two adjacent stand-by positions, i.e., on the left and right sides, respectively, of the production position, the new roll of the web stands ready for processing. Namely, since the left and the right sides of the roll of the web being located on the production position come off from the production line, during the period when the roll of the web is continuously fed, the new roll of the web can stand ready for processing on the left and right sides. In these positions, preparation for joining the end of the roll of the web, which is being continuously fed out from the production position, and the end of the new roll of the web is possible. For example, if auxiliary tape is used to join the end of the web being used and the end of the new roll of the web in any of the stand-by positions, the preparation for joining can be performed in advance by adhering half of the auxiliary tape to the end of the new web roll and the like.

When the web located in the production position is continuously fed out so that it becomes exhausted, simply moving the new roll of the web standing ready for processing in any of the stand-by positions in a lateral direction allows the same to be located in the production position.

At that moment, the splicing unit is actuated. Thus, a possibility not only of automatically joining the end of the web being used with the end of the new roll exists, but also of continuously supplying the latter web into the production line.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The accompanying drawings illustrate embodiments of the splicing device for the package webs according to the present invention and are given by way of illustration only, and thus, are not limitative of the present invention, and wherein.

DESCRIPTION OF THE PREFERRED EMBODIMENTS

A description of the preferred embodiments according to the present invention is made in conjunction with the accompanying drawings.

Figure 1:
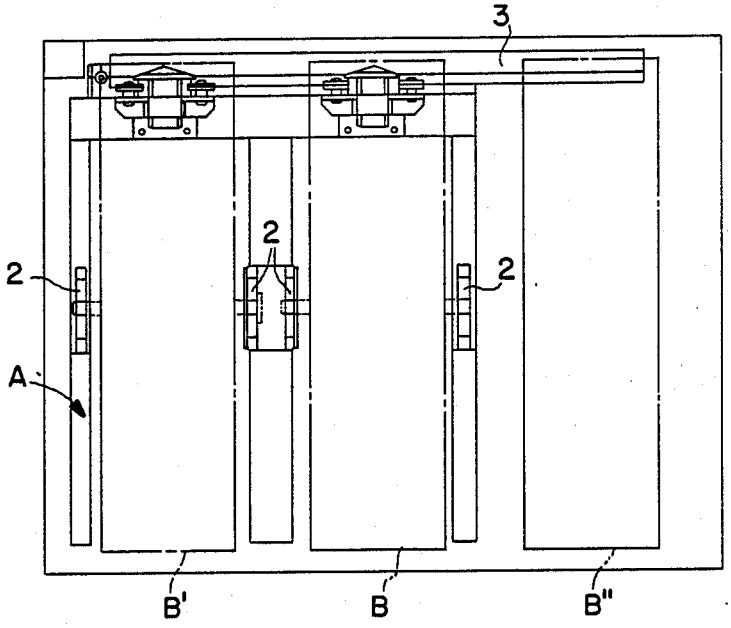
FIG. 1 is a plan view of the twin type magazine capable of housing the two rolls of the web therein.
Figure 2:
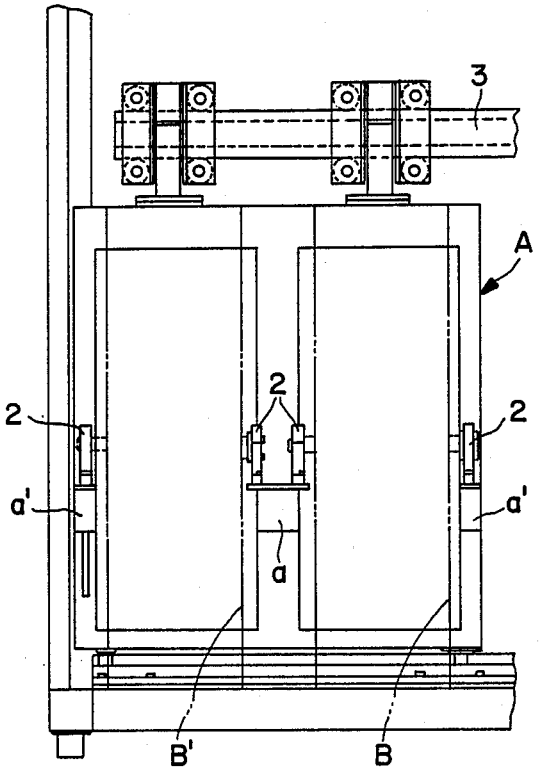
FIG. 2 is a front view of the magazine.
Figure 3:
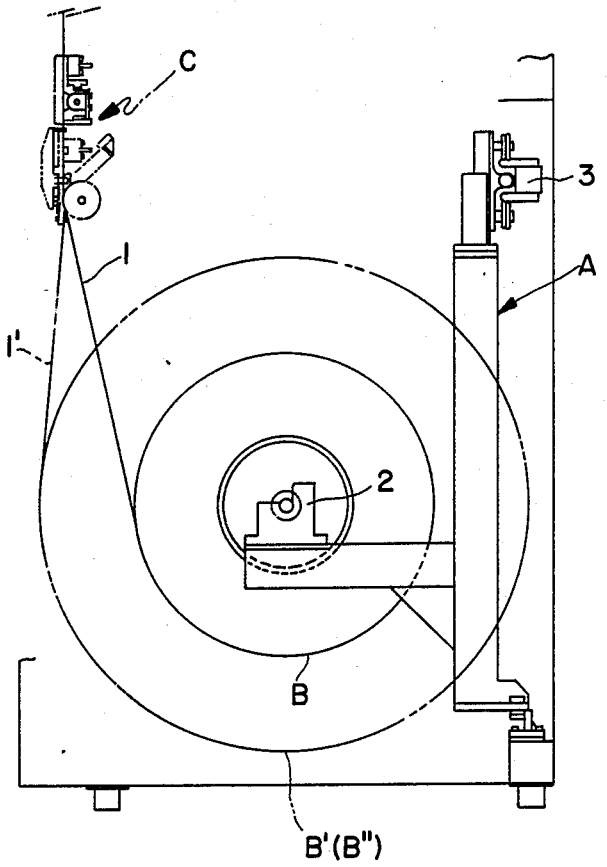
FIG. 3 is a side view of the magazine.

As shown in FIGS. 1 to 3, the magazine (A) has a space large enough to house the two rolls of the packaging web (1) and has two pairs of left and right roll supporting articles (2) and (2) mounted on a supporting member (a) in the middle of the magazine (A) and on the left and right supporting member (a') and (a'), respectively. The magazine (A) can house the roll of the webs (B) and (B') in the left and right side-parts, respectively, of FIGS. 1 and 2, by means of a pair of left and right roll supporting articles (2) and (2) to hold a core of the roll of the packaging web (1). The right side-part of FIGS. 1 and 2 acts as the production position or on-line position in the production line, whereas the left side-part thereof acts as the stand-by position.

The twin type magazine (A) is movable along a guide rail 3 in a longitudinal direction of FIGS. 1 and 2. Movement of the magazine (A) from the state shown in FIG. 1 in the right direction will allow the roll of the web to be positioned where the prior roll of the web (B) was previously positioned. Such movement will also allow the part in which the roll of the web (B) was housed to be positioned in the side location as sown by a two-dot chain line (B'') in FIG. 1. In that case, without needing the magazine (A) to be of the twin type, an alternative may be two independent magazines capable of housing one roll of the web in each of them with an option of installing both the magazines, such that they are movable in a longitudinal directional along the guide rail (3).

Figure 12:
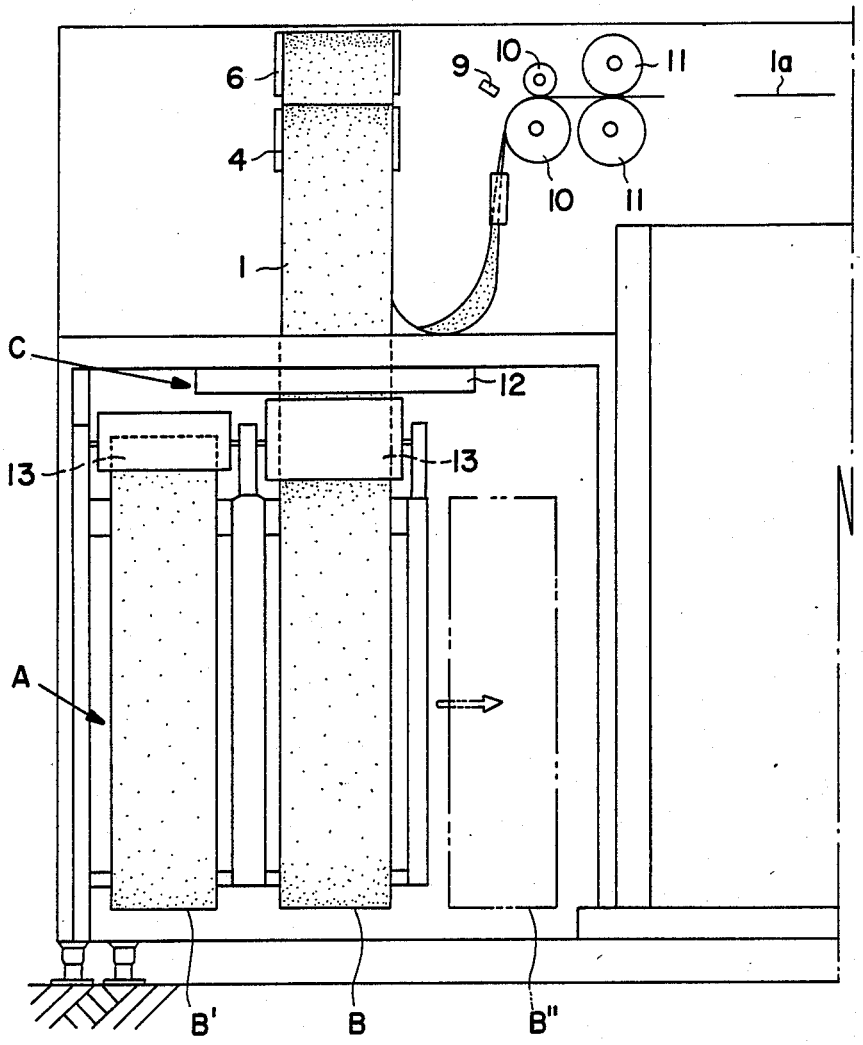
FIG. 12 is a front view illustrating the entire device with splicing units for supplying the packaging webs.

As shown in FIG. 12, for example, the magazine (A) having the aforementioned functions, can be used when manufacturing a packaging container. The packaging web, which is the raw material, is continuously fed out. The roll of the web (B) shown by a solid line in the right side of FIG. 12 is on the production line, i.e. at the production position, while another roll of the web (B') stands ready for processing in the stand-by position shown in the left side of the figure.

The roll of the web (B) located on the production line, i.e. at the production position, is continuously fed out to a feeding unit constituted by a braking roller (4), a crease wheel (5), a driving roller (6), and a pressure roller (7). This process will be described in detail hereinbelow. When the aforementioned roll of the web (B) is exhausted, it is ideally efficient that the new roll of the web to be subsequently used (B') is moved into the production position, whereby the new web (1') is continuously fed out further to the prior web (1). Nevertheless, although the roll of the web is so large and heavy that there is marked difficulty in quickly installing the new roll of the web in the production position after the web (1) becomes exhausted, the use of the magazine (A), as shown in the embodiment, will enable the new roll of the web (B') to stand ready for use in the stand-by position (the left side of FIG. 12), adjacent to the roll of the web (B). For this reason, during the period of manufacturing the packaging container on the production line using the roll of the web (B), it is possible for the new roll of web (B') to stand ready for processing in the stand-by position.

When the roll of the web becomes exhausted, the new roll of the web (B') can be adapted to be moved onto the production position by means of moving the magazine (A) in a right direction of FIGS. 1, 2, and 12, thereby permitting continuous manufacturing. Movement of the magazine (A) housing the two rolls in a right direction of FIGS. 1, 2, and 12, will result in the roll of the web which was housed in the prior production position to be located at the position at a side position shown by the two-dot chain line (B'') of FIGS. 1 and 12. At position (B'') adjacent the production position, the core and mandrel for the roll of the web (B) is removed and the new roll of the web to be subsequently used (B'') is set. Thereby, a roll of the web (B'') can be adapted to stand ready for processing in the aforementioned position. Furthermore, upon becoming exhausted, the web (B') located in the production position is moved by moving the magazine (A) in a reverse direction to that for the last process, i.e. in the left direction. The aforementioned roll of the web (B'') will then be in the middle production position, thereby enabling continued manufacturing.

A repetition of such an operation makes it possible to supply the new roll of the web at once, after the roll of the web is exhausted in the production position.

Whether the roll of the web (B) located on the production position is going to become exhausted after the process of continuous feeding out is detected by means of a detecting unit. For example, a photocell can be used which detects the vicinity of the article for supporting the roll (2) in the magazine (A). A detection of the end of the roll of the web by such a detecting unit will allow easy detection of any impending exhaustion of the roll of the web located in the production position.

Figure 13:
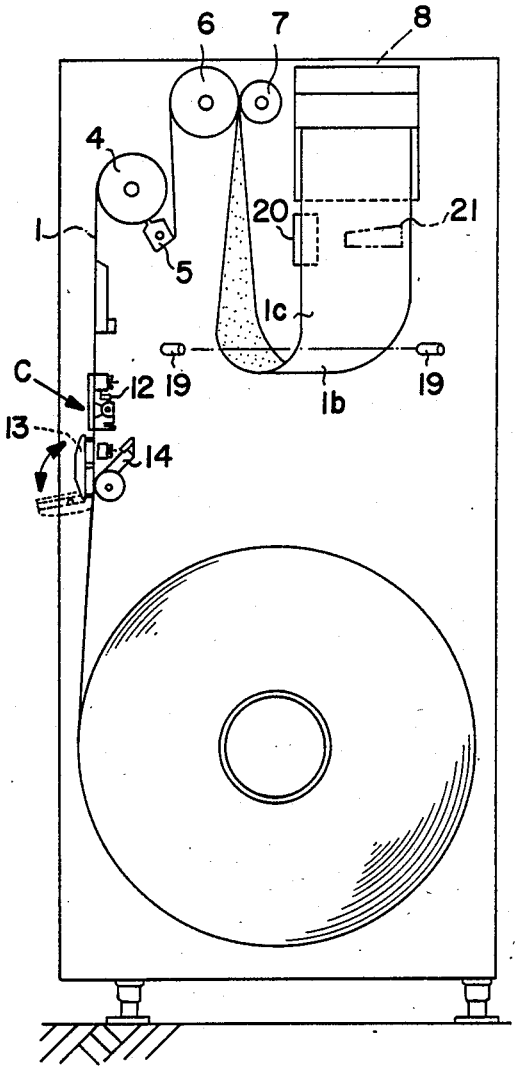
FIG. 13 is a schematic view taken from the side of FIG. 12.

The web (1) which is continuously fed out by means of the aforementioned feeding unit is cut into a blank sheet (1*a*) whose dimensional magnitude is equal to that of one unit of packaging container by a cutting unit (8) seen in FIG. 13. As seen in FIG. 12, the cutting unit (8) comprises a pair of driving rollers (10) and (10) and a photosensor (9) which detects a bar-code mark on the surface of the web. Detection of the bar code will cause an indexing and in feed of the web and will cause a pair of cutting rollers (11) and (11) to cut the web (1) into the blank sheet (1a) equal in size to one unit of a packaging container.

On the other hand, in order to continue to supply the packaging web in the production line so that the manufacturing process is not suspended, the end of the web (1) located on the production position needs to be joined to the end of the next new roll of the web (B') just after the roll of the web (B) is exhausted. A splicing unit (C) which performs this task is provided on the upper portion of the magazine (A).

Figure 4:
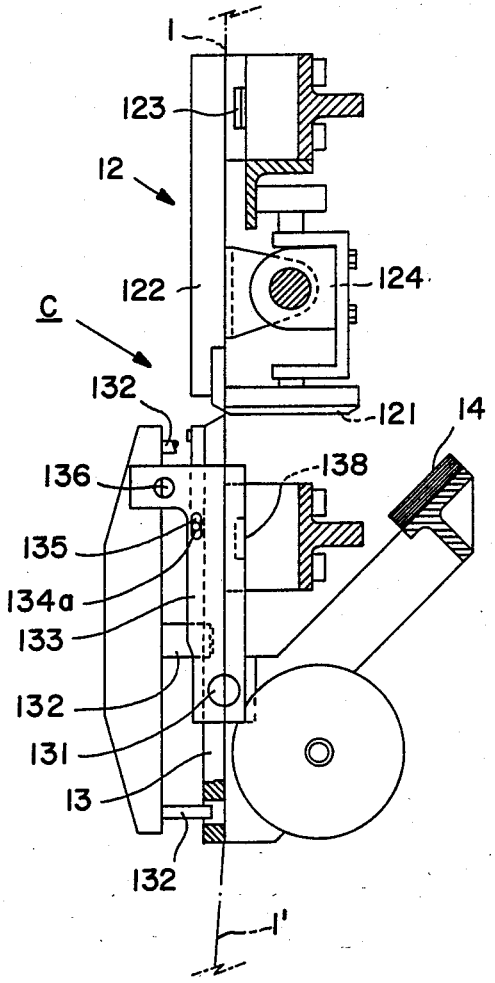
FIG. 4 is a partially cut-away side view of the splicing unit only.

As shown in FIG. 12, the splicing unit, according to the embodiment, comprises a cutting unit (12) fixed to the upper end of the magazine (A), splicing plates (13) and (13) disposed on the left and right positions (corresponding to the production position and the stand-by position) on the upper part of the magazine (A), and a pressure element (14) shown in FIG. 4.

Figure 5:
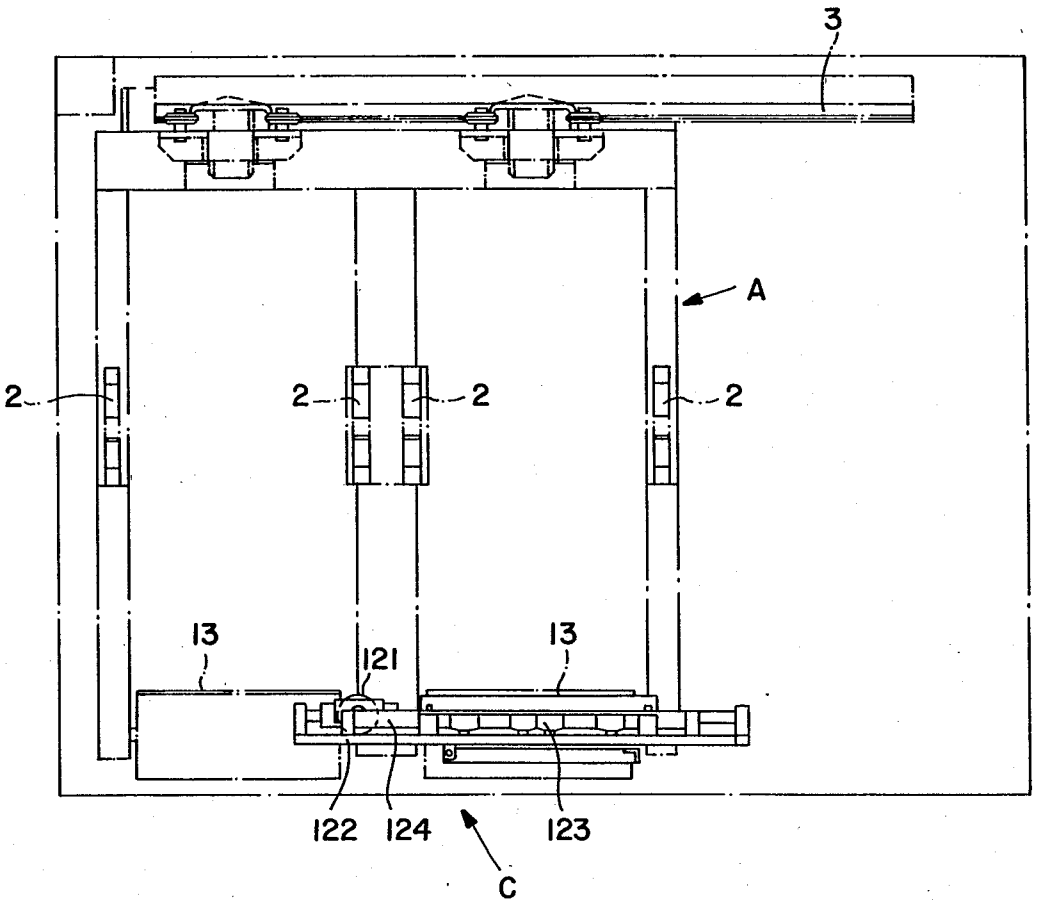
FIG. 5 is a plan view of the relationship between the splicing unit and the magazine.
Figure 9:
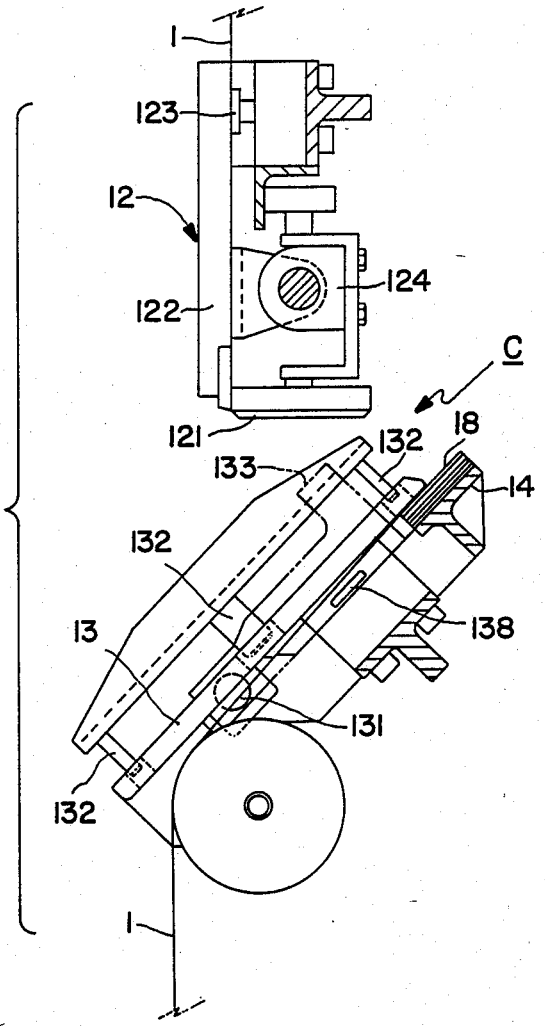
FIG. 9 is a side view illustrating the splicing plate having the joining preparation completed in the stand-by position together with the cutting unit located in the production position.

The cutting unit (12), which is always located at the production position, comprises a cutting edge (121) capable of being moved in a longitudinal direction of FIGS. 5 and 12, a cutting plate (122) fixed partially to the body of the device, and a clamp (123) for fixing the web when the web is cut by the aforementioned cutting edge (121). As shown in FIG. 9, while the web (1) being used is being pressed onto the cutting plate (122) by means of the clamp (123), the cutting edge (121) moves in a cross direction of the web (1) and enables the web (1) to be cut. In the embodiment, rotation of a magnetic cylinder (124) moves the cutting edge (121) in a cross direction of the web (1).

Figure 17:
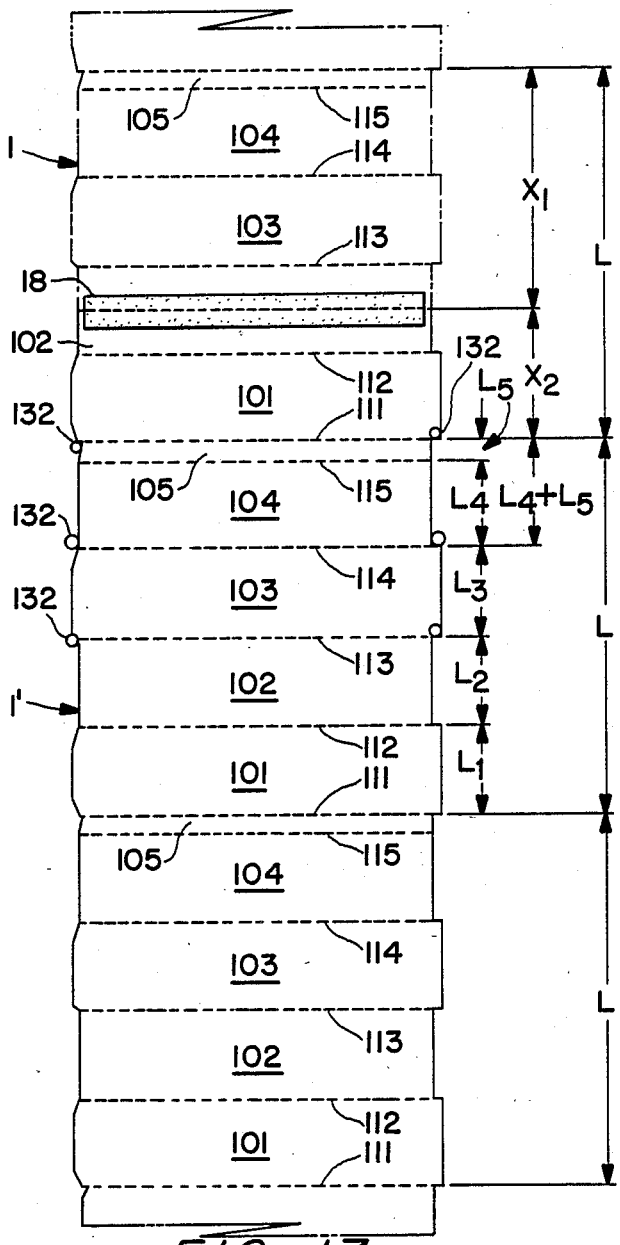
FIG. 17 is a plan view of the packaging webs which have been joined with each other.

As shown in FIG. 17, the web (1) has a sufficient length for crease lines (111)–(115) to extend across the web (1) with their fixed pattern being repeated. The range of the cutting unit (8) is indicated by (L) and is, therefore, equal in size to the blank sheet (1a) of one unit of the packaging container. Unless such a cutting process is made near the end of the web (1) being used, it difficult for the end of the web being used and the end of the next new roll of the web to be joined with each other for continuous manufacturing.

In order to join these webs, attention should be paid to the construction in which the longer web (1) causes the crease lines (111)–(115) to form panels (101)–(105) so that the same pattern is repeated. The end of the web being used (1) and the end of the next new web (1') are joined with the help of auxiliary tape (18) to each other at a predetermined position in the crease pattern, i.e. at a position dividing the panel (102) of FIG. 17 into two equal portions. The end of the web (1) being used is cut such that the length $X_1$ of the web is defined by $X_1=\frac{1}{2}$ $l_2+l_3+l_4+l_5$ which is equal in length to one unit of the container. The web whose length $X_2$ is defined by $X_2=l_1+\frac{1}{2}$ $l_2$ is extends from the top area of the pattern L for the end of the new web (1').

Figure 14:
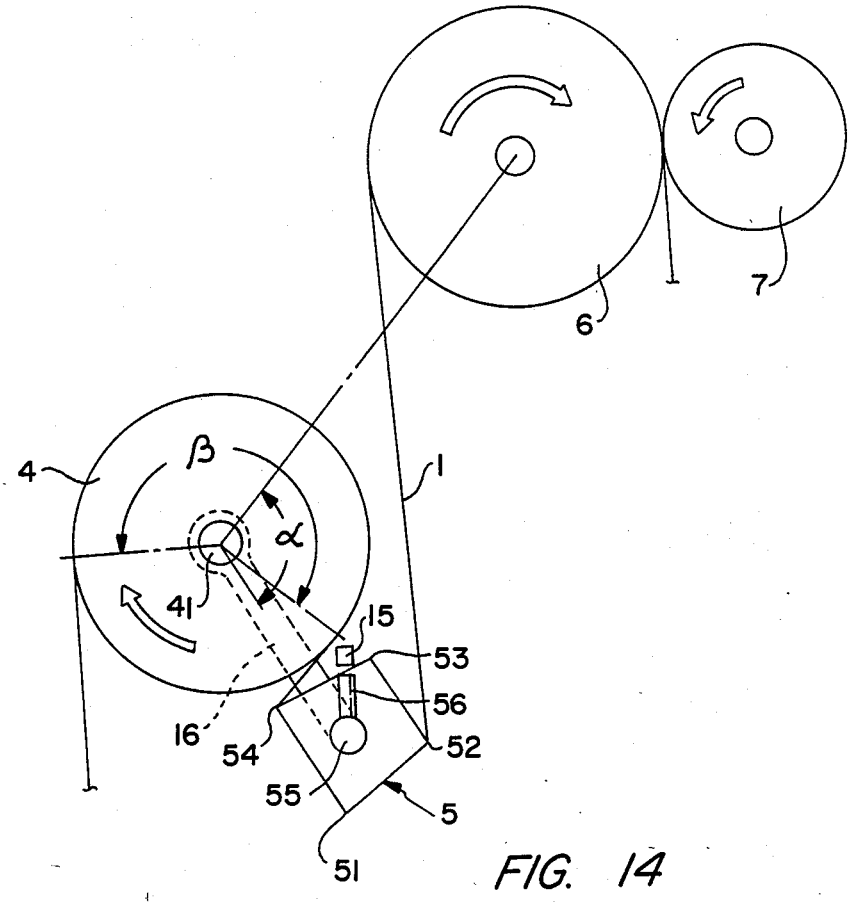
FIG. 14 is a schematic side view of the positional relationship between the driving roller, the braking roller, and the crease wheel during operation.
Figure 16:
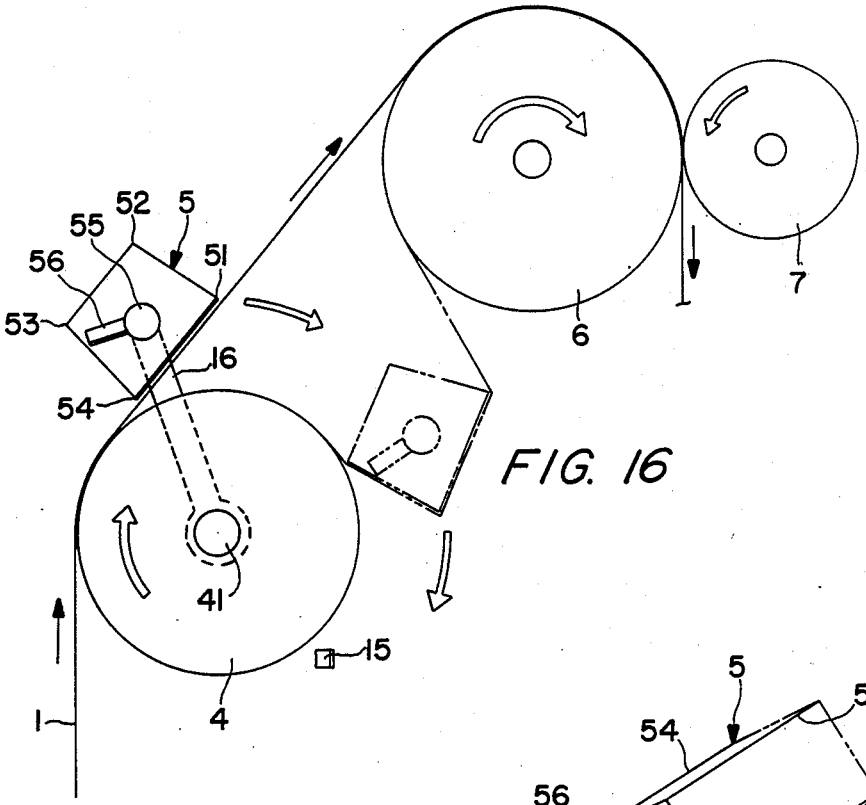
FIG. 16 is a schematic side view of the positional relationship between the driving roller, the braking roller, and the crease wheel at their stops.
Figure 15:
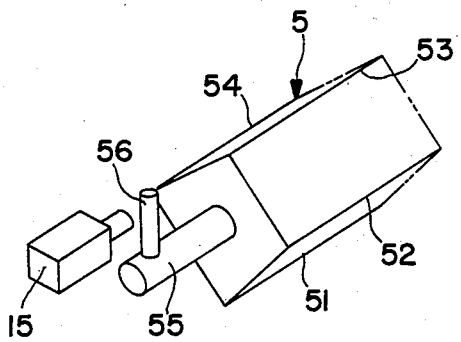
FIG. 15 is a perspective view of the unit for detecting the position of the crease wheel by means of sensors.

The crease wheel (5) shown in FIGS. 14–16 is part of the feeding unit for the web (1) so that the web may be fed out along a crease line while being folded. The crease wheel (5) is a rotational article equipped with edges (51)–(54) with the predetermined intervals left therebetween. The dimensions between the two corresponding edges of the four edges i.e. the dimensions between a pair of edges—(51) and (52), (52) and (53), and (53) and (54) will equal that of each of the panels (101) to (103) and the dimension between the edges (51) and (54) will equal $l_4+l_5$, so that the panel (104) and the panel (105) act as a margin to be pasted. When forming a cylinder, the blank sheet (1a) may be treated as one surface.

The constant cutting of the end of the web (1) being used, made at the fixed position of the crease pattern, can be done while the crease wheel (5) is stopped at a predetermined rotational position. The web (1) is cut at the fixed position rearward of the aforementioned rotational position by means of the cutting unit (12) partially constituting the splicing unit (C). Namely, the dimension $L_x$ from the crease wheel (5) being stopped at the predetermined rotational position to the cutting unit (12) of the splicing unit (C) is made constant, e.g. $L_x=nL+X_1$.

A further detailed description of the aforementioned feeding unit for the web (1) shown in FIGS. 15 and 16 will now be given. The feeding unit comprises the braking roller (4) equipped with an electromagnetic brake, the crease wheel (5) which feeds out the web (1) while folding the same along the crease lines (111)–(114) as referred to above, the driving roller (6) being driven by a motor, and the pressure roller (7). A rotating axle (55) of the crease wheel (5) is provided with a pin (56) which acts as a member to detect the rotational position thereof. This pin (56) extends from the external peripheral surface of the rotating axle (55). On the other hand, a sensor (15) is provided at a fixed position on the frame or the like to detect pin (56).

The sensor (15) detects the top end part of the aforementioned pin (56). In other words, the top end part of the pin (56) is on a rotational locus drawn with the rotating axle (55) of the crease wheel (5) as a center. The mounting position of the sensor (15) allows it to detect the top end face of the pin (56). As shown in FIG. 15, an alternative idea is for the sensor (15) to detect the side face of the top end part of the pin (56). Any number of arrangements can be used for the sensor (15) to detect the pin (56).

The positional relationship between the braking roller (4), the driving roller (6), and the crease wheel (5) shows that the crease wheel (5) is pivotable about the braking roller (4). The crease wheel (5) will move by an angle, $\alpha$, between the braking roller (4) and the driving roller (6). The tension of the web (1) ensures the folding of the creases, and the contact angle of the web with the braking roller (4) is large whereby sliding of the web during braking is avoided.

Nevertheless, since the web (1) is a special laminated material, when the web (1) is initially loaded at the commencement of the work, there is a possibility of incurring difficulty if the crease wheel (5) is located in the aforementioned position. From that view, as shown in FIGS. 14 and 16, the embodiment has the crease wheel (5) mounted to the top end part of an arm (16) which is pivotable about axle (41) at the center of the braking roller (4). To avoid difficulty at start up, the crease wheel (5) is positioned, as shown in FIG. 16 at a lifted position to allow the web (1) to be hung between the braking roller (4) and the driving roller (6) without being in contact with the crease wheel (5). The arm (16) is then adapted to be pivoted as shown by an arrow in FIG. 16 from the solid line to the dotted line position and then to the position as shown in FIG. 14.

The two splicing plates (13) of the aforementioned cutting unit (12) constitute a part of the splicing unit (C). The splicing plates (13), as shown in FIG. 12, are provided on the two left and right positions (corresponding to the production position and the stand-by position) of the upper part of magazine (A). One splicing plate (13) enables the end of the web (1) being used in the production position (which is cut at the fixed position by the cutting unit (12), as mentioned above), and the end of the new roll of the web moved to the production position to be joined with each other, as well as enables the new joined web (1') to be fed forward. Another splicing plate (13) at the end of the new roll of the web to be subsequently used stands ready for processing in the stand-by position. The aforementioned action will be repeated when the new roll of the web is moved onto the production position. Namely, this splicing plate (13) is pivotable as indicated in FIGS. 4, 6, 10, and 11, and FIGS. 8 and 9. The splicing plate (13) is pivotable about axle (131).

Figure 8:
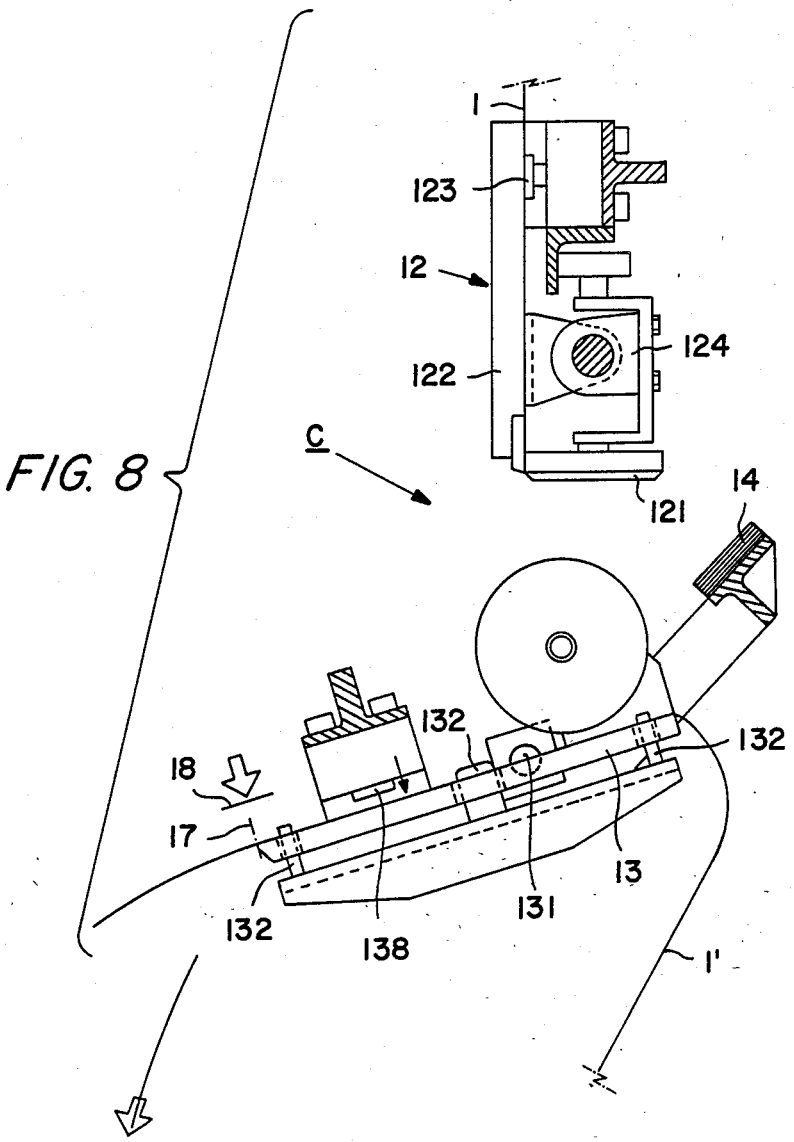
FIG. 8 is a side view illustrating the situation in which the joining preparation is presented to the end of the new roll of the web which is put on the splicing plate in the stand-by position, together with the cutting unit being located in the production position.

At the stand-by position, the splicing plate (13) is in the position shown in FIGS. 8 and 9. FIG. 8 illustrates the case where the end part of the new roll of the web (B') to be subsequently used is held so that preparation for joining the aforementioned end thereof and the end of the web (1) located on the production position with each other may be performed. In that case, the splicing plate (13) is moved about the axle (131) and the end of the new roll of the web to be subsequently used is put on the face thereof. The cutting is manually made at its predetermined position, i.e. the cutting position (17) by utilizing an edge of the splicing plate (13). Half of the auxiliary tape (18) can be adhered to the cut part. The cutting position is the position dividing the panel (102) of FIG. 17 into two equal parts, as mentioned above.

To facilitate positioning of the web on the splicing plate (13), three pins (132) are provided on the splicing plate (13) such that they are vertically separable from the face thereof. As shown in FIG. 8, the three pins (132) extend from the left to right sides of the splicing plate (13). By holding the notched stage part of the roll of the web to be subsequently used by each of the pins (132) which extend from the face of the splicing plate (13), as shown in FIG. 17, the end of the web (1') to be cut can easily be determined. Upon completion of positioning the web (1') on the splicing plate (13) by means of three pins (132), a clamp (138) is disposed on the splicing plate (13) by movement in the direction indicated by an arrow in FIG. 8 to press the end of the new web (1') on the splicing plate (13) so that said web (1') will not move. An arrangement is then made whereby the new web (1') is ready to be cut at its predetermined position.

Since the aforementioned work can be performed at a position offset from the production line, it can be done concurrently with continued production on the production line. Upon completion of the work, as shown in FIG. 9, the splicing plate (13) is pivoted whereby the joining preparation in the stand-by position is finished.

Figure 6:
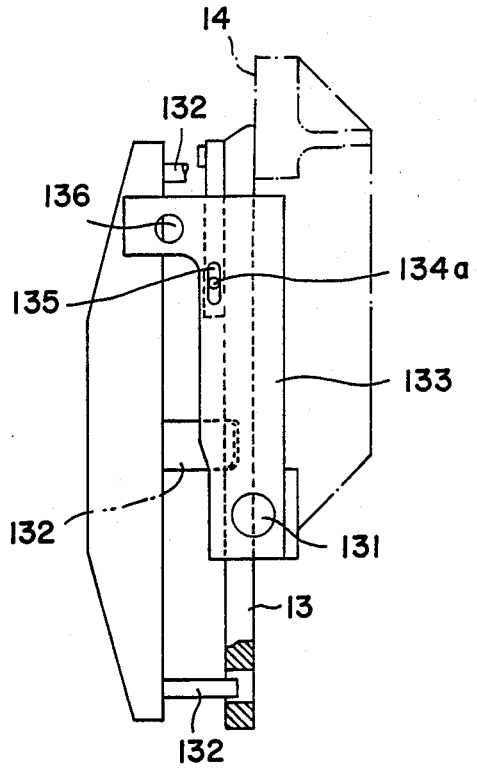
FIG. 6 is a side view of only the splicing plate partially constituting the splicing unit.
Figure 7:
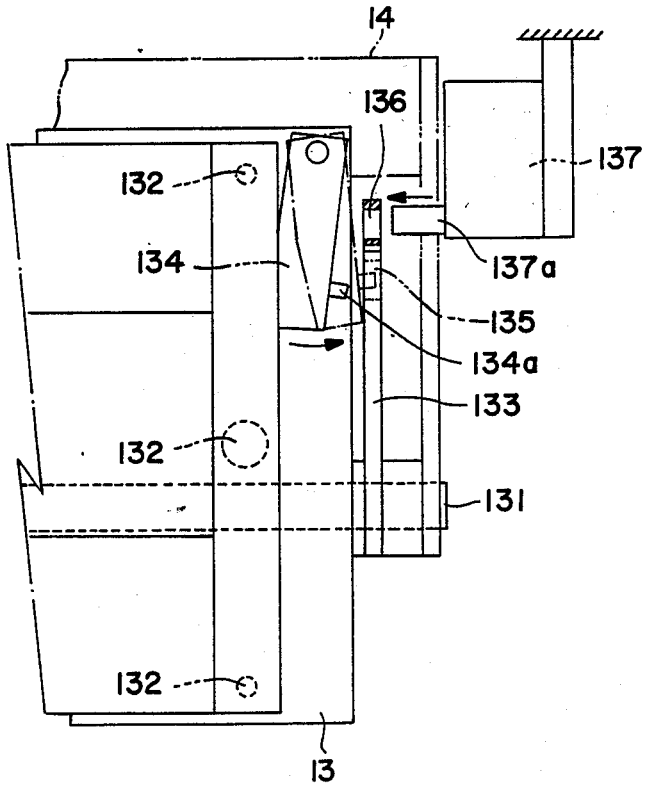
FIG. 7 is a back view of the positional relationship between the splicing plate, the locking arm, and the locking cylinder.

In the embodiment, as shown in FIGS. 4, 6, and 7, a locking arm (133) is rotatably mounted on the splicing plate (13). The locking arm (133) can move from the position as shown by solid lines in FIGS. 4 and 6 to the position shown by a chain line in FIG. 9. The locking arm (133) has a locking hook (134) mounted to the face of the splicing plate (13) and rotatable on the splicing plate (13) from the position shown by the solid line of FIG. 7 to a position as shown by the chain line of the same figure so that the pin (134*a*) may be inserted into a hole (135) to lock the splicing plate (13). Release of the pin (134*a*) and the hole (135) allows the splicing plate (13) to be inclined from the state, as shown in FIG. 9, into a position as shown in FIG. 8. When the splicing plate (13) is pivoted from the position shown in FIG. 8 to the position shown in FIG. 9, the locking arm (133) is locked in preparation for the joining process.

Another hole (136) is provided on the locking arm (133). This hole (136) receives the pin (137*a*) of the locking cylinder (137) located in the production position. To complete the joining process, the splicing plate (13) is moved from the stand-by position to the production position, and furthermore, the splicing plate (13) is moved from the position shown in FIG. 9 to the position shown in FIGS. 10 and 11. The pin (137*a*) of the locking cylinder (137) is then fitted into the hole (136), as shown by the arrow of FIG. 7, by actuation of the locking cylinder (137). The locking arm (133) will then be locked in the production position. In that case, if the splicing plate (13) is locked to the locking arm (133), the splicing plate (13) located in the production position is also indirectly locked, whereby joining work can easily be performed in the production position, as will be discussed below.

Figure 10:
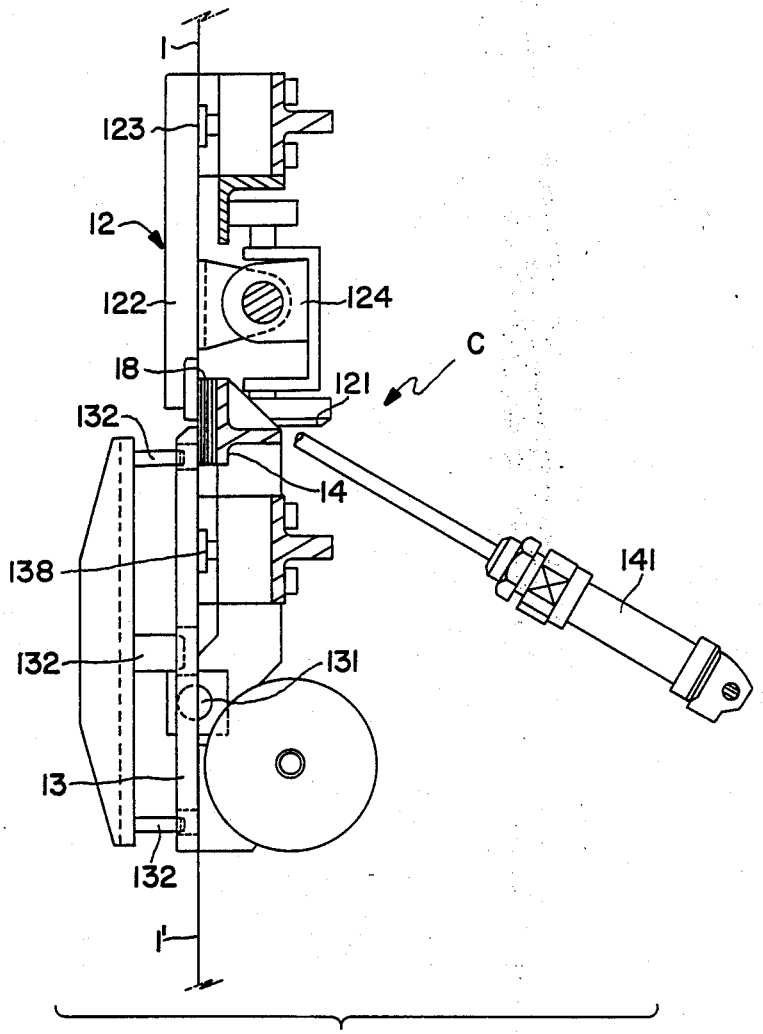
FIG. 10 is a side view of the situation in which the web being held in the splicing plate, which has been moved onto the production position, and the web being held in the cutting unit, are joined with each other.
Figure 11:
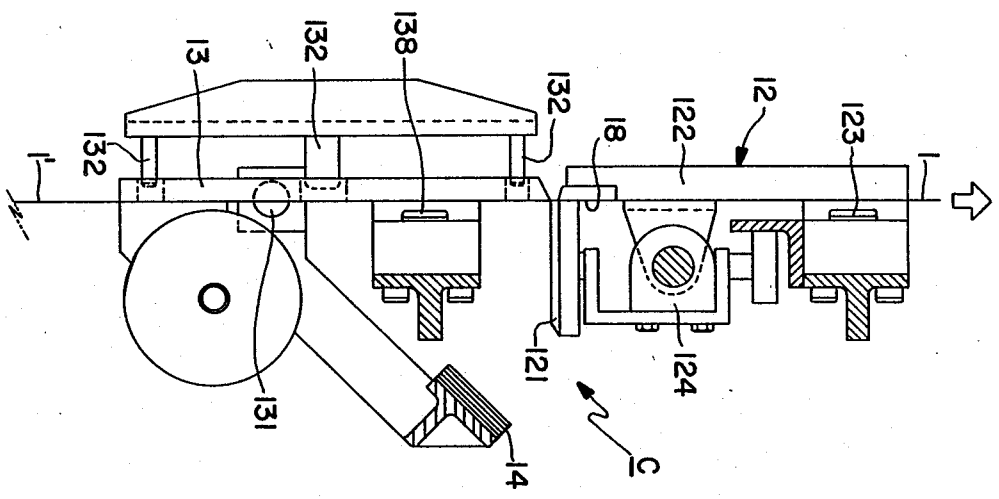
FIG. 11 is a side view of the situation in which both the webs are continuously fed out after being joined with each other.

Further to the aforementioned description in which the splicing plate (13) is in a stand-by position, as shown in FIG. 9, the splicing plate (13) stands ready for attaining the next function. While completing the preparation for the joining of the end of the new web (1'), a focus of the subsequent description is placed upon an arrangement in which when the web (1) in the production position is exhausted. Thereafter, lateral movement of the magazine (A) from the position as shown in FIG. 12 will cause the aforementioned splicing plate (13) to be moved toward the production position. Subsequently, the splicing plate (13) is adapted to be moved from the position of FIG. 9 to the vertical position as shown in FIGS. 10 and 11. Namely, as shown in FIG. 10, upon pivoting of the locking arm (133) together with the splicing plate (13) against a force of a tension spring (not shown), the top end of the new web (1'), which is held in the locking arm (133) is located such that an end is placed opposite the lower portion of the end of the web (1) being used which has been cut by the aforementioned cutting unit (12). In that case, as mentioned above, half of the auxiliary tape (18) has been adhered to the end of the new web (1') to be subsequently used. The remaining half of the auxiliary tape is overlapped to the end of the web (1) located in the cutting unit (12). The joining part being referred to herewith is the place where the vertical joining is made in FIG. 17 with the help of the auxiliary tape (18), whereby the remaining portion of the web (1) being used is subsequently joined to the end of the new web (1') at an exact position. The new web (1') is, therefore, continued with the same pattern being repeated after web (1) is exhausted.

The embodiment adapts the part of the web to be joined by the auxiliary tape (18) to be pressed once by the pressure element (14) so that this part is not separated. Namely, in order to press the joining part between the web (1) being used and the new web (1'), the cylinder (141) causes pivotable pressure element (14) to press the joining part. This cylinder (141) is pivotable about axle (131) of the splicing plate (13), as shown in FIG. 7. As shown in FIG. 10, the clamp (138) presses the new web (1') against the splicing plate (13), and as shown in FIG. 11, if the clamp (138) and the pressure element (14) are returned to the original position, it enables the new web (1') to be fed out in a forward direction.

Thus, it becomes possible for the new web (1') to be subsequently used after the web (1) with its remaining portion is used while continued production can be maintained.

The operation including the work of cutting the end part of the web (1) being used at its predetermined position by means of the cutting unit (12), the work for preparing to join the end of the new web (1') to the end of web (1'), the work of moving the roll of the web (1') onto the production position, and the work of joining both the webs (1) and (1') with each other are all interactively performed. This work is commenced when the end of the roll of the web (1) being used in the production position is encountered and/or when an operator desires a change in the type of web being used. In the case of interactive operation, in order to look for the position on the web (1) being used where the joining process ought to take place, the driving roller (6) which continuously feeds out the web (1) being used is switched from a high speed rotation to a low speed rotation. At that time, the sensor (15) is actuated, and upon the rotation of the crease wheel (5) to the solid line position of FIG. 14, the braking roller (4) is actuated so that the feed of the web (1) is stopped. Such an operation by the sensor (15) means that it is possible to accurately cut the web (1) at the proper position corresponding to the location of the cutting unit (12). Therefore, as mentioned above, the clamp (123) causes the web (1) which has been stopped to be pressed against the cutting plate (122) so that the vicinity of the end of the web (1) which is stopped on the cutting unit (12) is cut at the predetermined position. The part of the web (1) to be cut by the cutting edge (121) of the cutting unit (12) is also pressed against the splicing plate (13) by the clamp (138) of the splicing plate (13).

After that, actuation of the locking cylinder (137) in the production position will permit the locking arm (133) to be released, and the force of the tension spring (not shown) allows the locking arm (133) and the splicing plate (13) which is locked to the locking arm (133) to be moved as shown in FIG. 9. This position of FIG. 9 is the same as that for the stand-by position. For that moment, as mentioned above, the lateral moving of the magazine (A) permits the new web (1') which has completed the joining preparation in the stand-by position to be transferred onto the production position together with the splicing plate (13). Thereafter, upon pivoting of the splicing plate (13) together with the locking arm (133) from the state of FIG. 9 to the perpendicular position as shown in FIG. 10 and performing the pressing process by the pressure element (14), the web (1) being used and the new web (1') are joined with each other. Subsequently, if the clamp (138) is released while the pressure element (14) is pivoted to the production position shown in FIG. 11, manufacturing in the production line can be continued. In the production position, a repeated actuation of the locking cylinder (137) locks the splicing plate (13) in the perpendicular position.

Figure 18A:
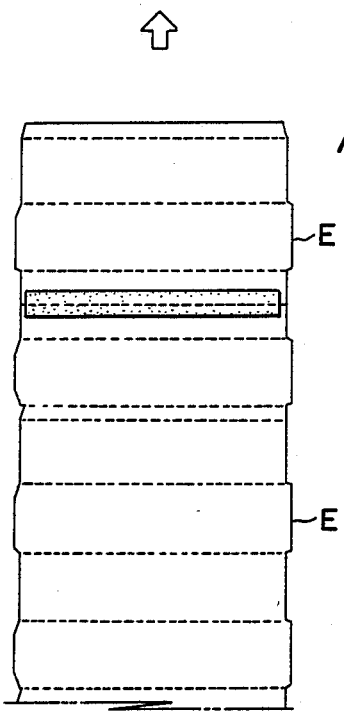
FIG. 18-(*a*), 18-(*b*), and 18-(*c*) are plan views of the examples of joining states of the webs, in which all the parts are: (1) and (1'): web, (12): cutting unit, (121): cutting edge, (122): cutting plate, (123): clamp, (124): magnetic cylinder, (13): splicing plate, (131): axle, (132): pin, (133): locking arm, (134): locking hook, (14): pressure element, (A): magazine, (B), (B'), (B''): roll of web, and (C): splicing unit.
Figure 18B:
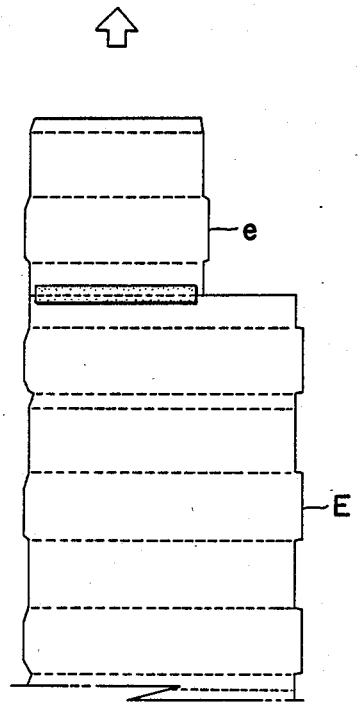
Figure 18C:
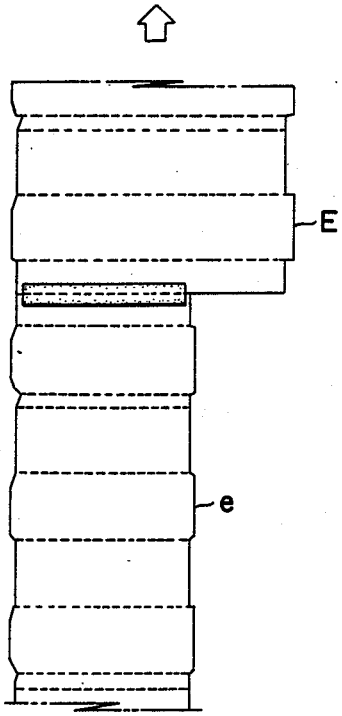

The splicing unit may be applied when the webs (E) and (E) are different in width from each other in addition to the case when webs (E) and (E) having the same width as shown n FIG. 18-(*a*) are joined with each other. In the case of the former joining, as shown in FIGS. 18-(*b*) and 18-(*c*), the joining is made while one-side margins are aligned with each other.

On the other hand, as shown in FIG. 13, the web (1) is located between the feeding-out unit comprising the braking roller (4), the crease wheel (5), the driving roller (6), and the pressing roller (7), and an introducing section to the cutting unit (8). The web (1) is provided with a sagging part (1*b*) dangling a predetermined distance. The lower end of the sagging part (1*b*) is detected by photocells (19) and (19) and control of the feeding speed of the feeding-out unit is possible by supplying an amount of the web adequate to the working speed of the subsequent process "cutting unit (8)". Furthermore, the web located between the feeding-unit and the subsequent process "cutting unit (8)" forms an approximately 90° angle of twist for the sagging part (1*b*) of the web. The weight of the web located in the sagging part (1*b*) acts to tension the feeding-out unit and the introducing section for subsequent processing so that sufficient force for pulling the web (1) for subsequent processing is available.

In this embodiment, one side margin of the introducing section of the web for the subsequent process is provided with a guide member (20). This guide member (20) catches the side margin (1*c*) of the web (1) so that aligning of webs different in width, as illustrated in FIGS. 18-(*b*) and 18-(*c*) can be done. The guide member (20) acts as a reference location for preventing the webs from wandering and twisting to ensure a smooth continuous running. In FIG. 13, a taper roller illustrated by a two-dot chain line prevents the web from floating and being twisted and adds a force for moving the web to the side of the guide member (20).

According to the present invention, since joining preparation can be to the new roll of the web in the stand-by position adjacent the production line before subsequent processing, the new roll of the web and the web located in the production position can be simply joined. The roll of the web which had undergone the joining preparation in the stand-by position is quickly transferred onto the production position. Not only is a decrease in manufacturing efficiency avoided, but also,a lot of labor for making a replacement between the webs is avoided.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A splicing device for packaging webs comprising:

a shiftable magazine unit having a first and a second magazine, each of said magazine being capable of housing a roll of a web, said magazine unit being movable between a first and a second position, said magazine unit when in said first position having the first magazine in an on-line position and the second magazine in a first stand-by position, said magazine unit when in said second position having the first magazine in a second stand-by position and the second magazine in the on-line position, the web within the magazine in the on-line position being used while the web in the first or second stand-by position is held ready for subsequent use when moved to the on-line position, said magazine unit being moved when the web in use is terminated; and splicing means for joining an end of the web in the magazine moved from either stand-by position to an end of the terminated web, said splicing means including first and second splicing units being located on said first and second magazines respectively, and said first and second splicing units being movable with said magazine unit.

2. The splicing device as recited in claim 1, wherein the web in the on-line position is terminated when a type of web to be used is changed or when the web in use is exhausted, each of said first and second magazines having means for supporting the web held therein.

3. The splicing device as recited in claim 1, wherein said splicing means further comprises means for cutting said web in use, said means for cutting being located adjacent said on-line position and receiving said web in use from said on-line position during use of said web.

4. The splicing device as recited in claim 3, further comprising means for feeding said web in use from said on-line position, said means for feeding positioning the web fed from the on-line position in said cutting means at a selected position when said web in the on-line position is to be terminated, whereby said cutting means will cut said web to be terminated at a position enabling a new web moved from either of the stand-by positions to the on-line position to be joined thereto by one of said first and second splicing units such that a pattern for the terminated web can continue with the new web without interruption.

5. The splicing device as recited in claim 4, wherein said means for feeding includes creasing means for selectively forming the pattern in the web, at least one drive roller for moving the web from the on-line position and at least one braking means for stopping the feeding of the web from the on-line position.

6. The splicing device as recited in claim 5, wherein said creasing means comprises a crease wheel and said braking means comprises a braking roller, said crease wheel being mounted to pivot about said braking roller to selectively form the pattern in the web.

7. The splicing device as recited in claim 1, wherein said splicing means further comprises:

means for cutting the web to be terminated, said means for cutting severs the web in a cross direction;

at least one splicing plate for receiving and holding an end of a new web to be used when the splicing unit for said new web is in one of the stand-by positions, whereby preparation for joining the new web and the web to be terminated can begin before said new web is moved to the on-line position; and at least one pressure element for pressing an end of the new web to an end of the web to be terminated.

8. The splicing device as recited in claim 7, wherein said means for cutting comprises a cutting plate, a cutting edge, and clamping means for locking the web to be terminated in position during cutting thereof by said cutting edge.

9. The splicing device as recited in claim 8, wherein said cutting edge is a roller knife.

10. The splicing device as recited in claim 8, further comprising a magnetic cylinder for moving said cutting edge to sever said web in the cross direction.

11. The splicing device as recited in claim 7, further comprising a locking arm pivotably mounted to said at least one splicing plate, said locking arm being pivotable between a locked and an unlocked position and having a locking hook.

12. The splicing device as recited in claim 11, further comprising at least one locking pin mounted on said at least one splicing plate for accurately positioning the end of the new web by inserting the at least one pin into a notched stage part of the new web.

13. The splicing device as recited in claim 7, further comprising at least one locking pin mounted on said at least one splicing plate for accurately positioning the end of the new web by inserting the at least one pin into a notched stage part of the new web.

14. The splicing device as recited in claim 7, wherein said at least one splicing plate and said at least one pressure element are pivotably mounted about a shaft.

15. The splicing device as recited in claim 7, wherein each of said magazines has a splicing plate and each of said magazines has a pressure element and wherein each of said splicing plates and each of said pressure elements are pivotably mounted to said respective magazines for movement about a shaft.

16. The splicing device as recited in claim 15, wherein each of said splicing plates has attached thereto a pivotable locking arm with a locking hook.

17. The splicing device as recited in claim 15, wherein each of said splicing plates has at least one locking pin mounted thereon, said pins enabling accurate positioning of the end of the new web by insertion thereof into a notched stage part of the new web.

* * * * *